US005383725A

United States Patent [19]

Swisher, Jr. et al.

[11] Patent Number: 5,383,725

[45] Date of Patent: * Jan. 24, 1995

[54] ASPHALT/DUST/RUBBER PROCESSING EQUIPMENT

[75] Inventors: George W. Swisher, Jr., Oklahoma City; Stuart W. Murray, Edmond, both of Okla.

[73] Assignee: CMI Corporation, Oklahoma City, Okla.

[ * ] Notice: The portion of the term of this patent subsequent to May 11, 2010 has been disclaimed.

[21] Appl. No.: 585,834

[22] Filed: Sep. 20, 1990

Related U.S. Application Data

[63] Continuation-in-part of Ser. No. 416,374, Oct. 2, 1989, Pat. No. 5,209,563.

[51] Int. Cl.[6] ..... B28C 5/46; B01F 15/02

[52] U.S. Cl. ..... 366/22; 366/34; 366/35; 366/149; 366/151; 366/178; 366/182; 222/145

[58] Field of Search ..... 366/20, 25, 40, 38, 366/151, 177, 181, 22, 28, 23, 34, 35, 37, 24, 6, 7, 8, 2, 149, 156, 182, 178; 432/111; 34/135, 136, 137, 33; 222/135, 145

[56] References Cited

U.S. PATENT DOCUMENTS

| | | | |
|---|---|---|---|
| 765,975 | 7/1904 | Hooley | 366/23 X |
| 775,414 | 11/1904 | Berrigan | 366/156 X |
| 1,531,594 | 3/1925 | Carozza et al. | 366/6 |
| 1,546,335 | 7/1925 | Browne | 366/35 X |
| 2,901,988 | 9/1959 | Hepburn | 366/156 X |
| 4,103,350 | 7/1978 | Brock et al. | 366/22 |
| 4,184,771 | 1/1980 | Day | 366/182 X |
| 4,211,490 | 7/1980 | Brock et al. | 366/11 |
| 4,384,787 | 5/1983 | Ito et al. | 366/40 X |
| 4,475,818 | 10/1984 | Bialkowski | 366/20 X |
| 4,506,982 | 3/1985 | Smithers et al. | 366/20 X |
| 4,518,262 | 5/1985 | Bornemann et al. | 366/181 X |
| 4,669,889 | 6/1987 | Yamaguchi et al. | 366/177 |
| 4,688,945 | 8/1987 | Brazelton et al. | 366/156 |
| 4,801,210 | 1/1989 | Gian | 366/156 |
| 4,838,701 | 6/1989 | Smith et al. | 366/27 X |

OTHER PUBLICATIONS

Dri-Flo, Inc., "Dri-Flo The Only All Purpose Pneumatic Pump" brochure, Jul. 1987.

*Primary Examiner*—David A. Scherbel
*Assistant Examiner*—Charles Cooley
*Attorney, Agent, or Firm*—Dunlap, Codding & Lee

[57] ABSTRACT

A closed, pressurized apparatus for introducing aggregate dust and rubber into a stream of liquid asphalt is provided. Aggregate dust and rubber are dispensed through a valve from a receiving chamber into a mixing housing. The aggregate dust and rubber enter the mixing housing at an intermediate location therein. The liquid asphalt is introduced into the mixing housing through a separate conduit at a location thereon above the point of entry of the aggregate dust and rubber. The liquid asphalt, the aggregate and the rubber combine within the mixing housing to form a slurry composition. A heating jacket substantially surrounds the mixing housing and a system for preventing liquid asphalt from backing up into the receiving chamber is also provided. The apparatus is particularly useful in an asphalt plant using a bag house.

30 Claims, 7 Drawing Sheets

ASPHALT/DUST/RUBBER PROCESSING EQUIPMENT

BRIEF SUMMARY OF THE INVENTION

This is a continuation-in-part of application Ser. No. 07/416,374 filed Oct. 2, 1989, U.S. Pat. No. 5,209,563 entitled "DUST RETURN SYSTEM."

FIELD OF THE INVENTION

The present invention is directed to a system for mixing a first and a second additive with liquid asphalt. More particularly, but not by way of limitation, the present invention relates to an apparatus for mixing dust, rubber and liquid asphalt.

BACKGROUND OF THE INVENTION

In the present state of the art of introducing particulate additives, such as reclaimed aggregate dust or mineral filler, into asphalt drum mixers, the additives are exposed to a spray of liquid asphalt in the drum mixer in an attempt to coat the additives. However, in many instances, a portion of the additives introduced into the drum mixer via the above method escape coating by the liquid asphalt spray. The uncoated additives that do not combine with the mixing aggregate materials within the drum are carried out of the drum in the exhaust gas stream and re-collected by the emission system. Consequently, the work load on the emission system is increased.

The present state of the art of introducing particulate rubber into asphalt drum mixers is largely undeveloped. One process uses a proprietary blender to mix crumb rubber with liquid asphalt, the mixture is then placed in an agitated storage tank for at least an hour. Prior to this invention, asphalt plants required a great deal of additional equipment to enable them to produce asphalt-/rubber paving.

The present invention eliminates these disadvantages by providing a closed, pressurized system for thoroughly coating the additives with liquid asphalt. The additives are injected into a stream of liquid asphalt and become suspended therein producing a slurry. In this state, additives (such as dust) adhere to the mixing asphaltic materials within the drum; thus reducing emissions and providing greater control of the product composition. In addition, the present invention provides a simple addition to an asphalt plant for adding rubber to liquid asphalt.

BRIEF DESCRIPTION OF THE INVENTION

FIG. 6 is an elevational view of a dust/rubber pump with portions removed illustrating some internal structures.

DETAILED DESCRIPTION OF THE DRAWINGS

Figure 1:
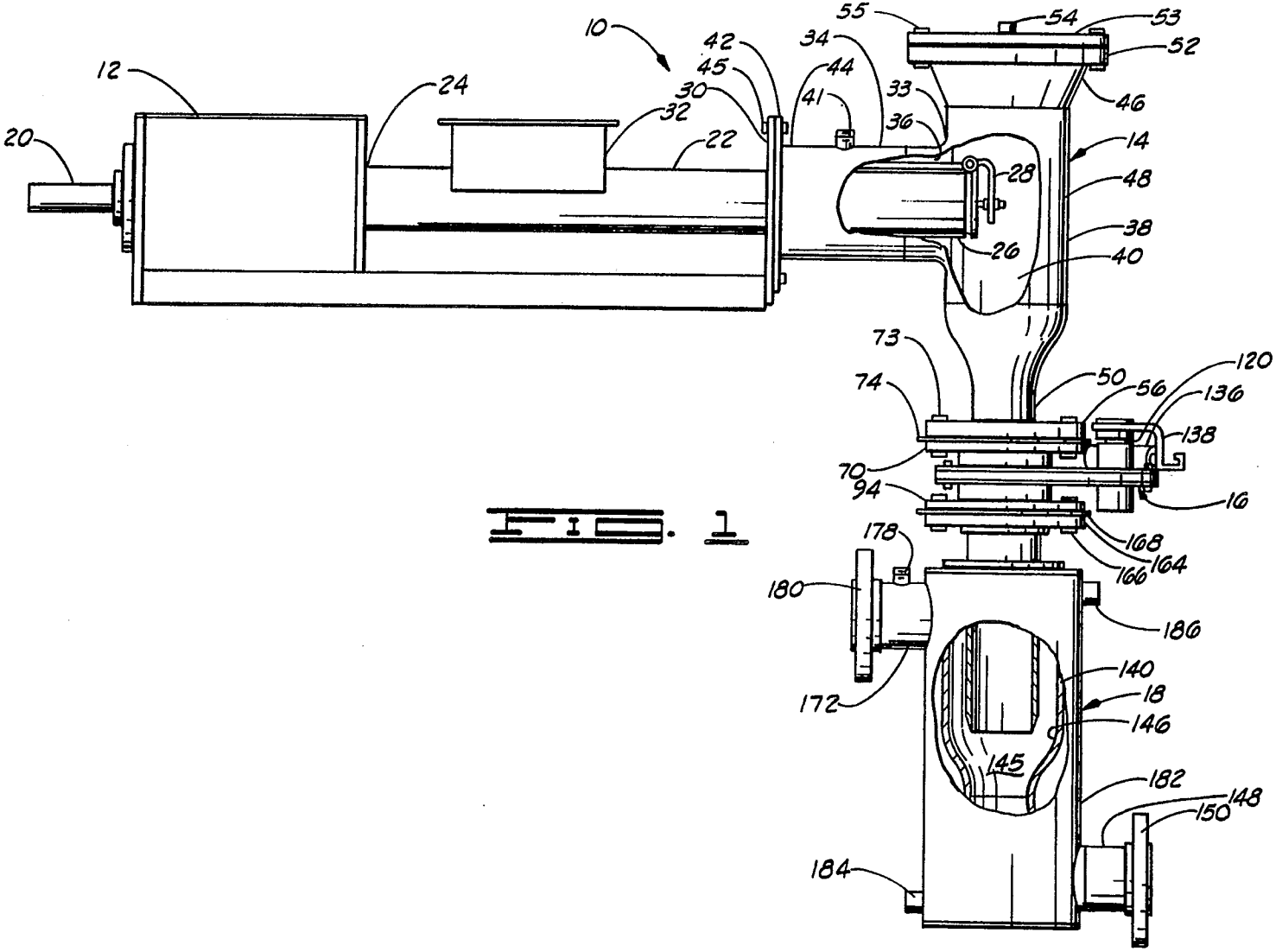
FIG. 1 is an elevational view of an embodiment of the asphalt/dust/rubber processing equipment constructed in accordance with the present invention, with portions removed to illustrate some internal structure.

As shown in FIG. 1, the present invention comprises asphalt/dust/rubber processing equipment designated generally by the reference numeral 10. The processing equipment 10 generally comprises a pump 12, preferably model number 410, manufactured by Dry-Flo, Inc., Denver, Colo.; a receiving housing 14; a valve 16 and mixing chamber 18.

The pump 12 is provided with an external drive assembly connected to shaft 20 for powering an auger 21 (FIG. 6) described in greater detail below. The auger 21 extends into a cylinder 22 which is secured at a first end 24 to the drive assembly 23. A second end 26 of the cylinder 22 is provided with a one-way valve 28 which extends into the receiving housing 14. A flange 30 is secured to the exterior of the cylinder 22 between the first end 24 and the second end 26 for a purpose to be discussed below. In operation, particulate materials enter the cylinder 22 through an inlet structure 32 (as from a bag house or rubber storage hopper) and are urged by the rotation of the auger 21 towards the second end 26 and into the receiving housing 14.

The housing 14 is formed by the intersection of a first end 33 of a horizontal duct 34 with a vertical duct 38. A cavity 36 in the horizontal duct 34 communicates with a cavity 40 in the vertical duct 38 at the intersection of the horizontal duct 34 and the vertical duct 38. A pressurized gas inlet fitting 41 extends from the horizontal duct 34 for a purpose to be discussed below.

Figure 8:
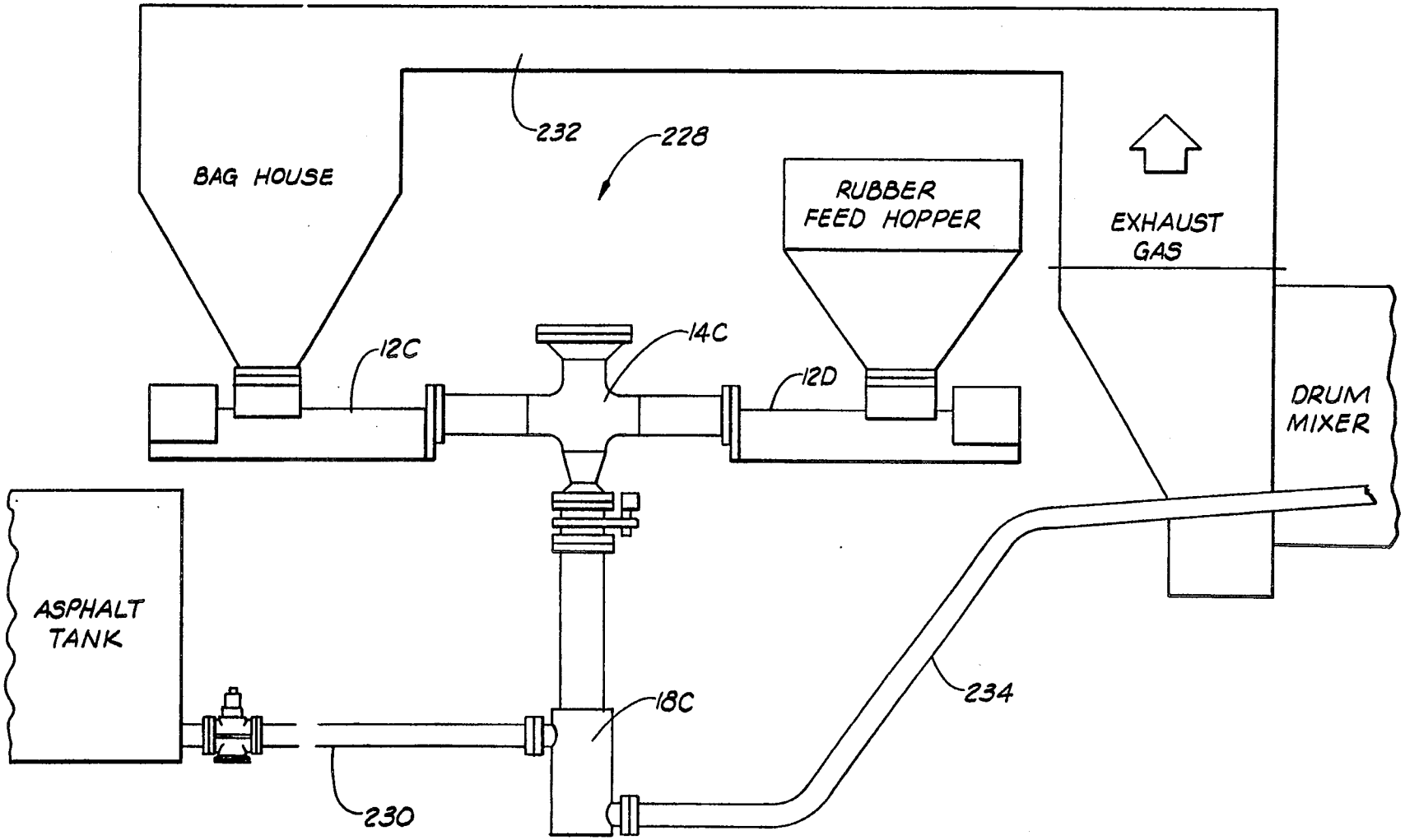
FIG. 8 is a schematic illustration of an asphalt plant illustrating another embodiment of the asphalt/dust-/rubber processing equipment.

The portion of the cylinder 22 between the second end 26 and the flange 30 extends through horizontal duct 34 and into the cavity 40 of the vertical duct 38. A flange 42, secured to a second end 44 of the horizontal duct 36, is attached to the flange 30 of the cylinder 22 by a plurality of bolts 45. In this way, the pump 12 is secured to the receiving housing 14. Multiple pumps may be secured to the receiving housing 14 by the addition of ducts like duct 34 (FIG. 8).

The cavity 40 of the vertical duct 38 is defined by an expanded first end 46, a cylindrical body 48 and a reduced second end 50. A flange 52 is provided at the upper portion of the first end 46. A plate 53, having a fitting 54 for a purpose to be discussed below, and sized for overlying the flange 52, is removably secured thereto by a plurality of bolts 55. A flange 56 is provided at the lower portion of the second end 50 for securing the receiving housing 14 to the valve 16.

Figure 2:
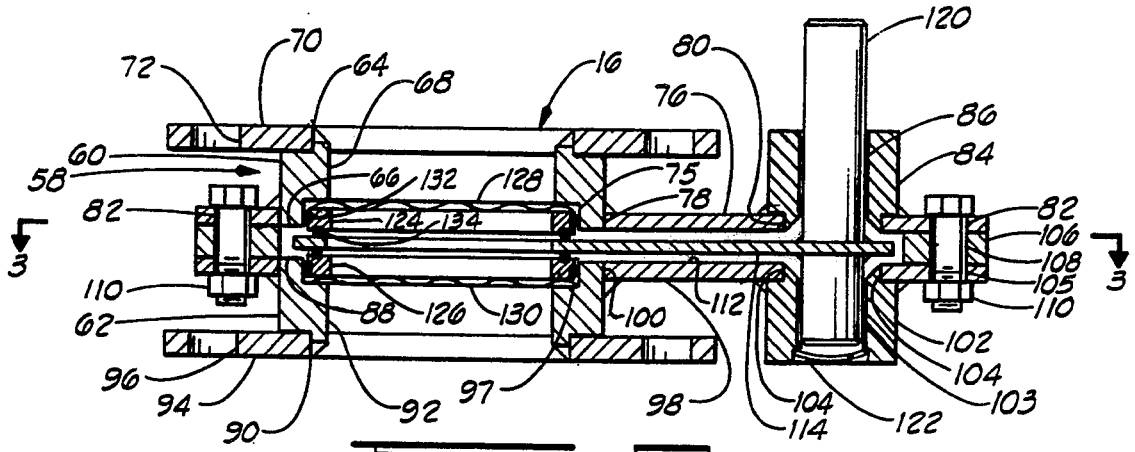
FIG. 2 is an enlarged vertical cross-sectional view of the valve portion of the asphalt/dust/rubber processing equipment.
Figure 3:
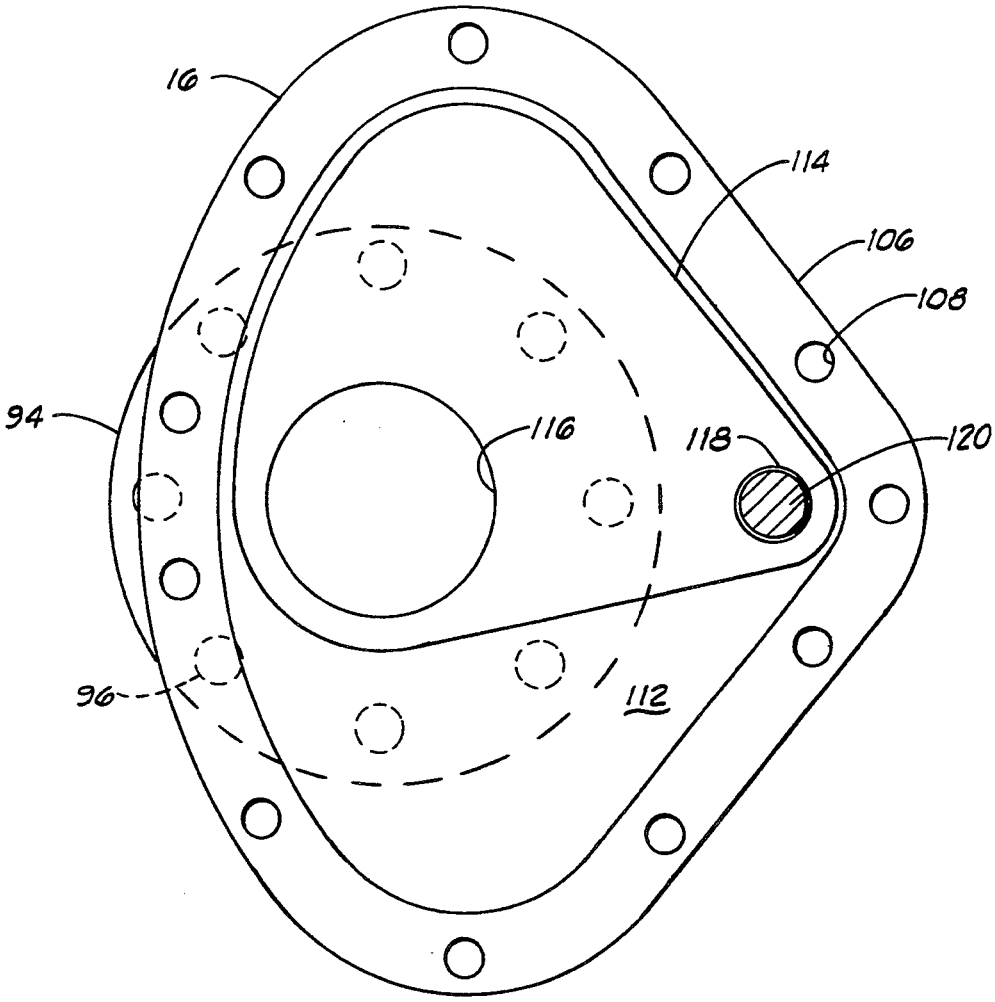
FIG. 3 is a cross-sectional view taken along lines 3—3 in FIG. 2.

As most clearly shown in FIGS. 2 and 3, the valve 16 includes a valve body 58 having separable upper and lower body portions 60 and 62. The upper body portion 60 has an upstream end 64, a downstream end 66 and a bore 68 extending therethrough.

At the upstream end 64, a flange 70, having a plurality of peripheral apertures 72, is secured thereto. Bolts 73 (FIG. 1), extending through the apertures 72 of the flange 70 and apertures (not shown) in the flange 56, secure the valve 16 to the housing 14. A gasket 74 may be positioned between the flanges 56 and 70 to ensure the seal between the valve 16 and the housing 14. At the downstream end 66, an annular groove 75 encircles the interior surface thereof for a purpose described in detail below.

A pear-shaped plate 76 having a first aperture 78, a second aperture 80 and a plurality of apertures 82 peripherally oriented thereon, is secured, as by welding, to the downstream end 66 of upper body portion 60 such that the bore 68 communicates the first, aperture 78. A sleeve 84, having a bore 86 extending therethrough, is secured, as by welding, to the plate 76 such that the bore 86 is vertically aligned with the second aperture 80.

The lower body portion 62 is provided with an upstream end 88, a downstream end 90 and a bore 92 extending therethrough. At the downstream end 90, a flange 94, having a plurality of peripheral apertures 96, is secured thereto. At the upstream end 88, an annular groove 97 encircles the interior surface thereof for a purpose described in detail below.

A plate 98, similar in construction to the plate 76, is secured, as by welding, to the upstream end 88 of the lower body portion 62 such that the bore 92 communicates with a first, aperture 100 in the plate 98. A sleeve 102, having a bore 103 extending therethrough, is secured, as by welding, to the plate 98 such that the bore 103 is in vertical alignment with a second aperture 104 in the plate 98. The plate 98 is also provided with a plurality of apertures 105 peripherally oriented thereon.

A spacer ring 106, having a plurality of apertures 108 therein, is positioned between the plates 76 and 98 such that the apertures 82, 108 and 105 are vertically aligned. Bolts 110, extending through apertures 82, 108 and 105, snugly secure the spacer ring 106 between the plates 76 and 98. Securing the plates 76 and 98, as described above, vertically aligns the bore 68 of the upper body portion 60 with the bore 92 of the lower body portion 62 and the bore 86 of the sleeve 84 is aligned with the bore 103 of sleeve 102.

The positioning of the spacer ring 106 as described above forms a cavity 112 defined by the plates 76 and 98 and the inner vertical wall of the spacer ring 106. A pear-shaped valve disk 114, having a first aperture 116 and a second aperture 118 (FIG. 3) is captured within the cavity 112. A shaft 120, sized for rotational movement within sleeves 84 and 102, extends through the bore 86 of the sleeve 84 and the second aperture 118 of the valve disk 114 and terminates within the bore 103 of the sleeve 102. The valve disk 114 is secured, as by welding, to portions of the shaft 120 adjacent the second aperture 118 such that the valve disk 114 is spaced equally between the plates 76 and 98. A plug 122 is secured to the lower end of the sleeve 102.

A pair of sealing rings, 124 and 126, each sized for insertion into the annular grooves 75 and 97, respectively, are urged by wave springs 128 and 130, against the valve disk 114. Each of the sealing rings, 124 and 126, is provided with a pair of O-rings 132 and 134. The O-ring 132 is positioned between the sealing ring and the adjacent annular groove. The O-ring 134 is positioned between the sealing ring and the valve disk 114.

The valve 16 is actuated by a ram 136 (FIG. 1). The ram 136 is connected to the shaft 120 by a lever arm 138. Movement of the lever arm 138 by the ram 136 rotates the shaft 120 such that the valve disk 114 is pivoted within the cavity 112 between an open position (FIG. 3) and a closed position (not shown). In the open position, the first aperture 116 of the valve disk 114 vertically aligns with bores 68 and 92. In this way, particulate material collected within the receiving housing 14 is dispensed into the mixing chamber 18. In the closed position, portions of the valve disk 114 form an occlusion between the bores 68 and 92 such that particulate material from the receiving housing 14 is prevented from entering the mixing chamber 18.

Figure 4:
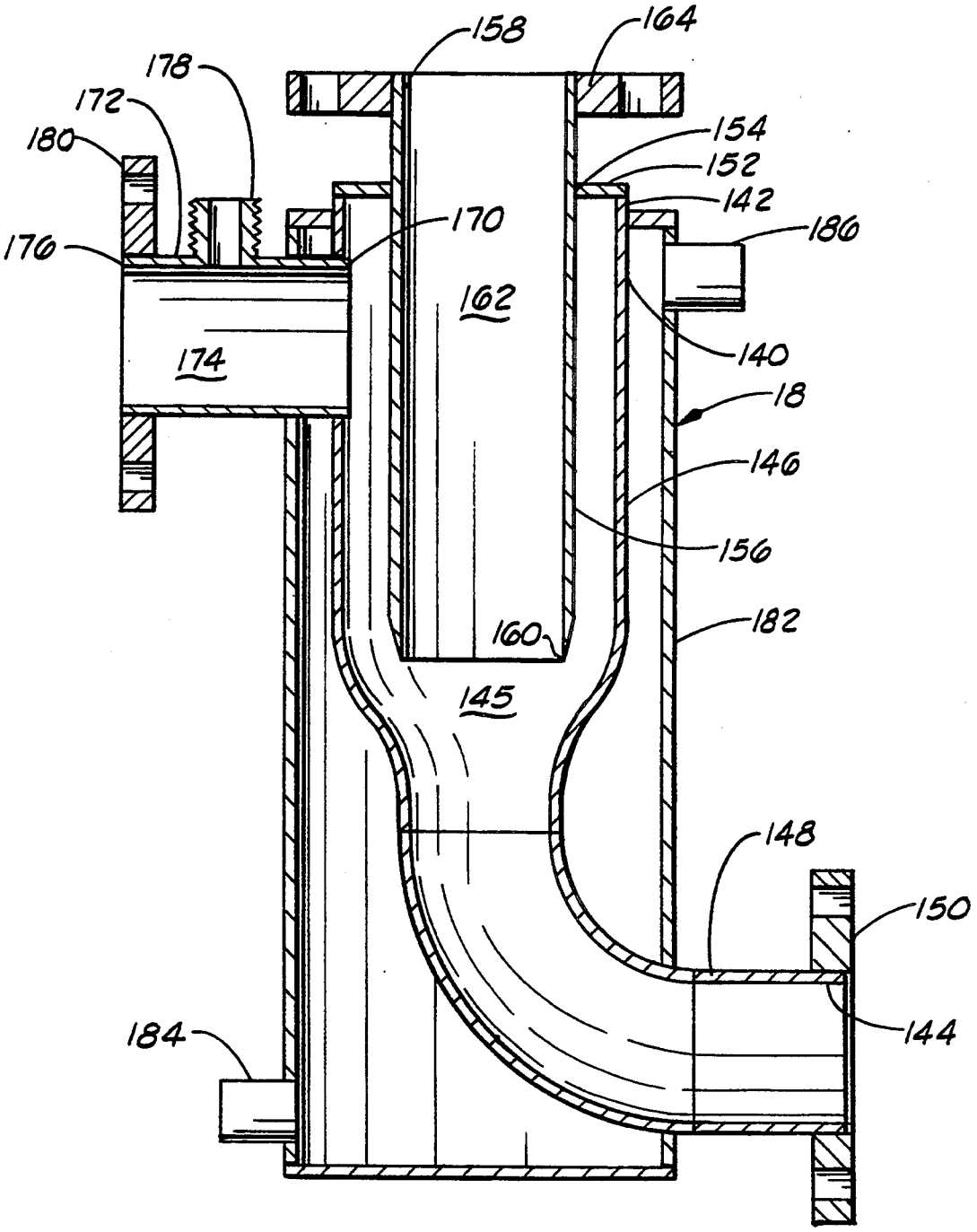
FIG. 4 is an enlarged vertical cross-sectional view of the lower portion of the equipment illustrated in FIG. 1.

As shown in FIG. 4, the mixing chamber 18 is provided with a cylinder 140 having a first end 142, a second end 144 and an opening 145 intersecting the first and second ends 142 and 144. The cylinder 140 is provided with an expanded portion 146 extending from the first end 142 and terminating at an intermediate location along the length thereof. A smaller diameter portion 148 extends from the second end 144 and terminates at an intermediate location along the length of the cylinder 140 adjacent the expanded portion 146. A flange 150 is secured to the second end 144 of the cylinder 140.

A ring 152, having an aperture 154, overlies and is secured to the first end 142 of the cylinder 140 such that the opening 154 concentrically aligns with the opening 145 at the first end 142. A duct 156, having a first end 158, a second end 160 and an opening 162 intersecting the first and second ends 158 and 160, extends through the aperture 154 and is centered within the opening 145. The duct 156 is secured to the ring 152 such that the first end 158 is above the ring 152 and the second end 160 is substantially adjacent the transition between the expanded portion 146 and the reduced portion 148 of the cylinder 140.

A flange 164, secured to the first end 158 of the duct 156, is secured to the flange 94 (FIG. 1) by a plurality of bolts 166. A gasket 168 may be positioned between the flanges 94 and 164 to ensure the seal between the valve 16 and the mixing housing 18.

With continued reference to FIG. 4, a first end 170 of a conduit 172 extends through an aperture in the expanded portion 146 of the cylinder 140. An opening 174 within the conduit 172 communicates with the opening 145 at a location therein substantially adjacent the first end 142 of the cylinder 140. The opening 174 traverses the length of the conduit 172 and connects the first end 170 with a second end 176 thereof. An apertured fitting 178 extends from the conduit 172 at an intermediate location thereon for a purpose to be discussed below. Additionally, a flange 180 is provided at the second end 176 of the conduit 172.

A heating jacket 182 substantially surrounds the cylinder 140 and is provided with an inlet fitting 184 and an outlet fitting 186. The upper and lower ends of the jacket 182 are closed. A heated liquid, preferably oil, is circulated through the jacket 182 to assist in maintaining the flow of the liquid asphalt through the mixing housing 18.

Figure 5:
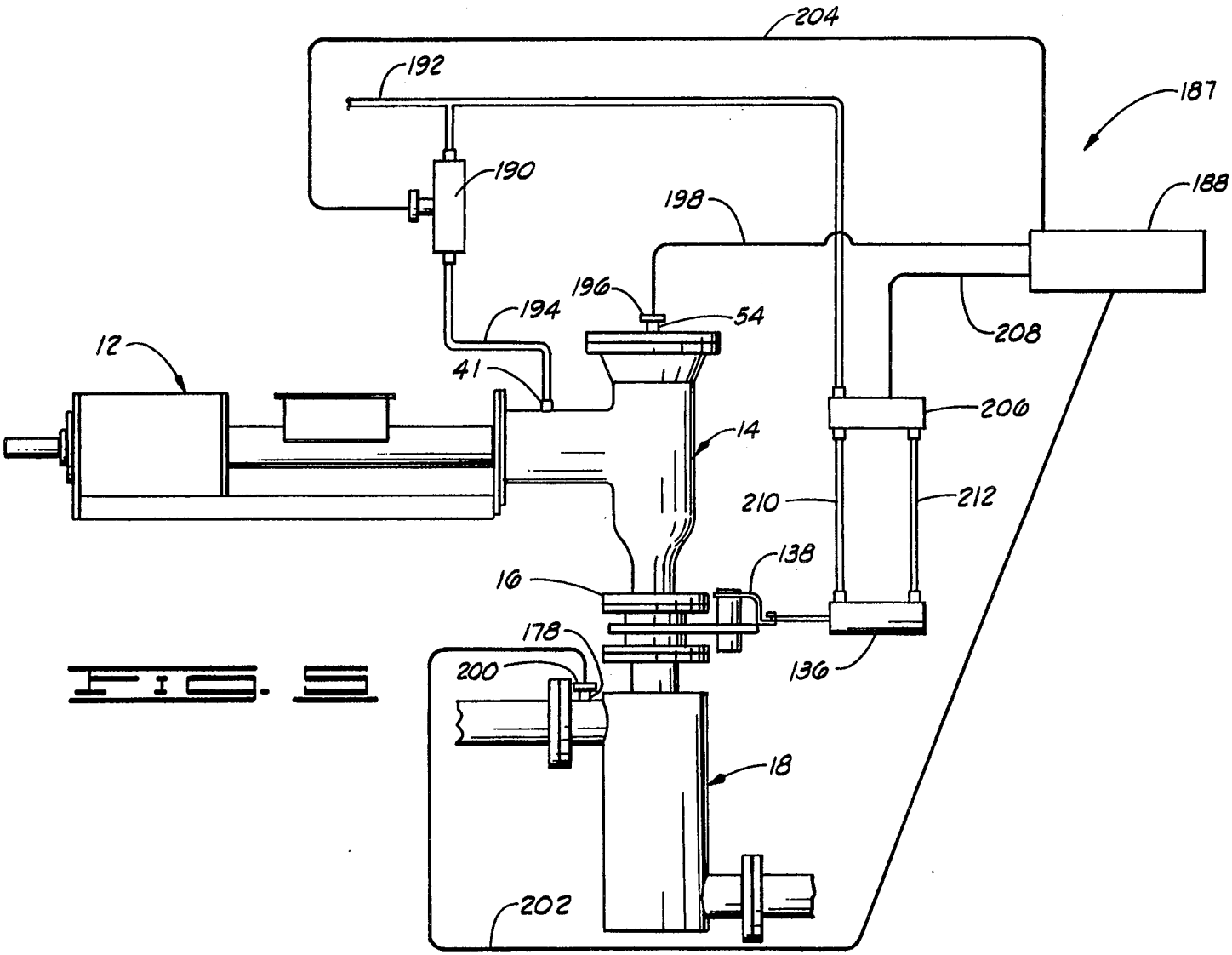
FIG. 5 is a semi-schematic illustration of a pressure monitoring system.
Figure 5:
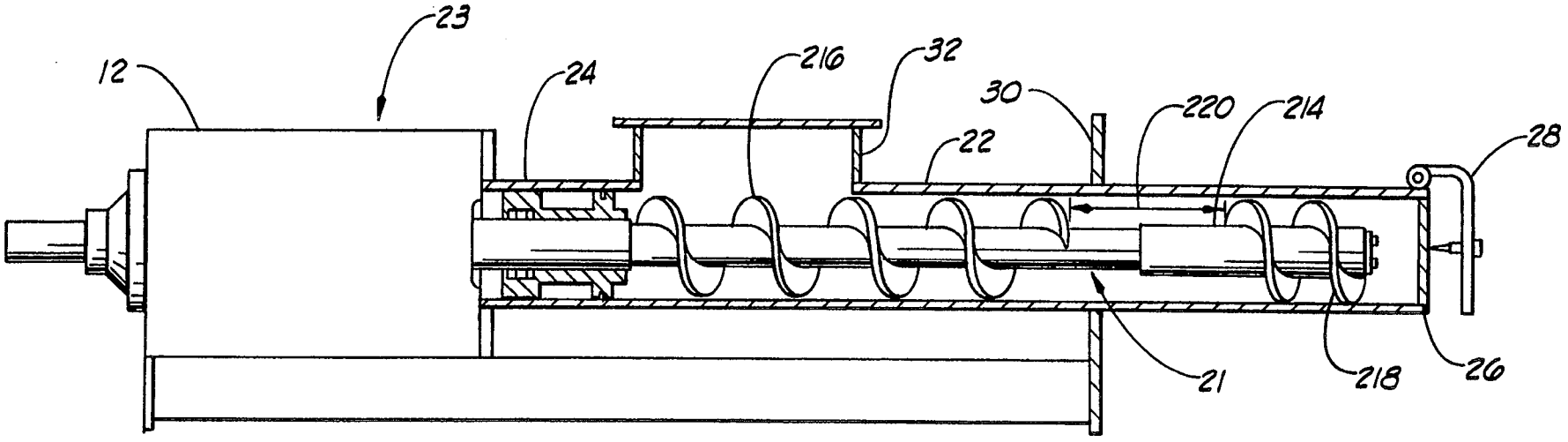

As shown in FIG. 5, a pressure monitoring system 187, utilizing a computer 188, controls the flow of particulate material through the valve 16. An automatic pressure regulator 190, responsive to the computer 188 and supplied by a gas pressure line 192, pressurizes the receiving chamber 14 via line 194 and inlet 41.

A pressure sensor 196, secured to the fitting 54, generates a computer input signal which is transmitted to the computer 188 by the electrical conduit 198. This computer input signal corresponds to the pressure within the receiving chamber 14. A pressure sensor 200, secured to the fitting 178, generates another computer input signal which is transmitted to the computer 188 by the electrical conduit 202. This computer input signal corresponds to the pressure of the liquid asphalt within the mixing housing 18.

The computer 188 compares the signal from the pressure sensor 200 with the signal from the pressure sensor 196. If the signal from the pressure sensor 200 does not exceed a preselected value, the computer 188 generates a first and second computer output signal. The first computer output signal is transmitted to the regulator 190 through an electrical conduit 204. The second computer output signal is transmitted to a solenoid 206 through an electrical conduit 208.

The regulator 190 responds to the first computer output signal by maintaining the pressure in the receiving chamber 14 at a selected differential above the pressure of the liquid asphalt, in the mixing housing 18. In this way, liquid asphalt is prevented from entering the receiving chamber 14. The solenoid valve 206 responds to the second output signal by pressurizing the ram 136 via a pressure line 210 such that the valve 16 opens.

If the signal from the pressure sensor 200 exceeds the preselected value, the solenoid 206, responsive to a third computer output signal generated by the computer 188 and transmitted by the electrical conduit 208, reverses the flow of pressurized gas into the ram 136 via lines 210 and 212 causing the valve 16 to close. The regulator 190, responsive to the fourth computer output signal, closes, preventing further pressure buildup in the receiving housing 14.

It will be understood that the preselected value and the selected differential may vary according to the nature and construction of the materials and components used in building the system. In the use of the present invention, for returning dust from a bag house to a drum mixer, the selected differential may be 0.2 PSI and the preselected value may be equivalent to 30 PSI gauge.

As shown in FIG. 6, the auger 21 includes a rotatable shaft 214 and pair of discontinuous helical blades, 216 and 218. Helical blade 216 extends along the shaft 214 from the inlet structure 32 to an intermediate point on the shaft 214. Helical blade 218 extends along the shaft 214 from the second end 26 of the cylinder 22 and terminates a distance 220 from the helical blade 216.

Particulate material entering the inlet structure 32 is urged within the cylinder 22 toward the valve 28 by the rotation of the helical blade 216. As sufficient quantities of particulate material enter the area between the helical blades 216 and 218, a slug of particulate material (not shown) is formed. As additional quantities of particulate material enter the cylinder 22 from the bag house, the material slug lengthens filling the area within the cylinder 22 defined by the distance 220. The slug of particulate material creates a gas lock within the cylinder 22 between the additive supply and the receiving housing 14. The gas lock prevents a turbulent flow of carrier gas, such as compressed air, from entering the receiving housing 14. By substantially eliminating the turbulent flow of carrier gas into the receiving housing 14, the particles and the liquid asphalt may be more evenly combined within the mixing chamber 18.

Portions of the material slug contacting the rotating helical blade 218 are removed therefrom and conveyed through the valve 28 into the receiving housing 14. Once inside the receiving housing, the particulate material transits the valve 16 and combines with a stream of liquid asphalt within the mixing chamber 18 such that a slurry stream of particulate material and liquid asphalt is formed.

As a result of the gas lock created in the cylinder 22 and the stream of liquid asphalt through the mixing chamber 18, along with the pressure monitoring system 187, the receiving housing 14, the valve 16 and the mixing chamber 18 in concert form a closed, pressurized environment in which the slurry of particulate material and liquid asphalt is formed.

Figure 7:
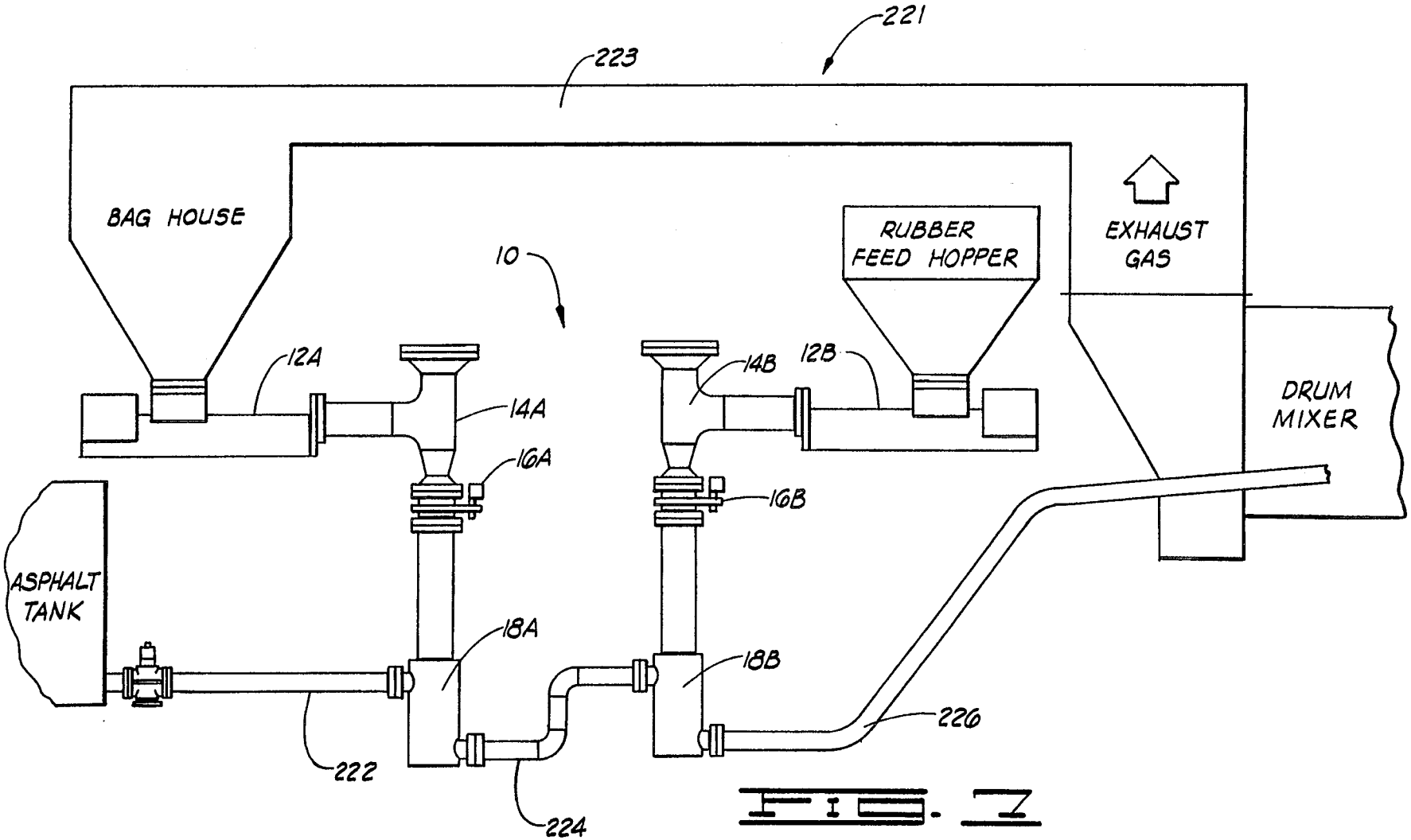
FIG. 7 is a schematic illustration of an asphalt plant illustrating one embodiment of the asphalt/dust/rubber processing equipment.

FIG. 7 schematically illustrates one embodiment of the asphalt/dust/rubber processing equipment 10 installed in a conventional asphalt plant 221. In operation, liquid asphalt is conveyed from the asphalt storage tank through conduit 222 to the mixing chamber 18A. Air borne particulate additive generated in the drum mixer enters the bag house via conduit 223 and is collected therein. The collected particulate additive enters the pump 12A and is urged into the receiving housing 14A as described above. The particulate additive transverses the valve 16A, and is combined with the liquid asphalt within the mixing chamber 18A to form a first slurry stream. The first slurry stream exits the mixing chamber 18A and is conveyed via conduit 224 to mixing chamber 18B. Particulate rubber additive stored in a rubber feed hopper enters the pump 12B and is urged into the receiving housing 14B as described above. The rubber transverses the valve 16B and combines with the liquid asphalt/dust within the mixing chamber 18B to form a second slurry stream. The second slurry stream exits the mixing chamber 18B and is conveyed via conduit 226 into the drum mixer for combination with the asphaltic materials therein. It is not significant which additive is mixed with the liquid asphalt first and it should be appreciated that the order set out above is for the purpose of illustration only.

FIG. 8 schematically illustrates another embodiment of the asphalt/dust/rubber processing equipment in a conventional asphalt plant 228. In operation, liquid asphalt is conveyed from the asphalt storage tank through conduit 230 to the mixing chamber 18C. Air borne particulate additive generated in the drum mixer enters the bag house via conduit 232 and is collected therein. The collected particulate additive enters the pump 12C and is urged into the receiving housing 14C as described above. Particulate rubber selectively released from the rubber feed hopper enters the pump 12D and is urged into the receiving housing 14C as described above. The asphalt, dust and rubber are combined within the mixing means 18C to form a asphalt/dust/rubber slurry stream. The asphalt/dust/rubber slurry stream exits the mixing chamber 18C and is conveyed, via conduit 234 into the drum mixer for combination with other asphaltic materials therein.

Changes may be made in the combination and arrangement of the parts or elements, as well as in the steps or procedures, without departing from the spirit and scope of the invention as defined in the following claims.

What is claimed is:

1. An apparatus for mixing a first and a second additive with a stream of liquid asphalt comprising:

a source of first additive;

a source of second additive;

means for mixing the first additive, the second additive and the stream of liquid asphalt;

means for dispensing the additives into the mixing means such that the additives are dispensed generally into the center of the stream of liquid asphalt; and a pressurized environment formed by the mixing means and the dispensing means.

2. The apparatus of claim 1 wherein the dispensing means comprises means for receiving the first and second additive.

3. The apparatus of claim 2 wherein the dispensing means further comprises a valve wherein the valve interrupts the flow of the additives from the receiving means to the mixing means when the pressure of the liquid asphalt at the mixing means exceeds a preselected value.

4. The apparatus of claim 3 wherein the mixing means comprises:

a cylinder having a first end and a second end; and means for introducing the stream of liquid asphalt into the cylinder to flow toward the second end.

5. The apparatus of claim 3 further including a thermal jacket substantially surrounding the mixing means.

6. The apparatus of claim 2 wherein one of the additives is rubber.

7. The apparatus of claim 2 further comprising means for maintaining the pressure in the pressurized environment at a selected pressure above the pressure of the liquid asphalt at the mixing means.

8. The apparatus of claim 2 wherein the mixing means comprises:

a cylinder having a first end and a second end; and wherein the cylinder is further characterized as having an expanded portion extending from the first end and terminating at an intermediate location on the cylinder.

9. The apparatus of claim 8 wherein the mixing means comprises:

means for introducing the additives into the cylinder to flow toward the second end; and means for introducing the stream of liquid asphalt into the cylinder to flow toward the second end.

10. The apparatus of claim 8 further including a thermal jacket substantially surrounding the mixing means.

11. The apparatus of claim 8 wherein one of the additives is rubber.

12. The apparatus of claim 8 further comprising means for maintaining the pressure in the pressurized environment at a selected pressure above the pressure of the liquid asphalt at the mixing means.

13. An apparatus for mixing a first and a second additive with a stream of liquid asphalt comprising:

a source of first additive;

a first means for mixing the first additive with the liquid asphalt to form a stream of first additive-liquid asphalt mixture;

a first means for dispensing the first additive into the first additive mixing means such that the first additive is dispensed generally into the center of the stream of liquid asphalt;

a source of second additive;

a second means for mixing the second additive with the stream of first additive-liquid asphalt mixture;

a second means for dispensing the second additive into the second additive mixing means such that the second additive is dispensed generally into the center of the stream of first additive-liquid asphalt mixture;

a first pressurized environment formed by the first dispensing means and the first mixing means; and a second pressurized environment formed by the second dispensing means and the second mixing means.

14. The apparatus of claim 13 wherein the first dispensing means comprises a first valve and wherein the first valve interrupts the dispensing of the first additive from the first dispensing means to the first mixing means when the pressure of the stream of liquid asphalt at the first mixing means exceeds a preselected value, and wherein the second dispensing means comprises a second valve, wherein the second valve interrupts the dispensing of the second additive from the second means for dispensing to the second mixing means when the pressure of the stream of first additive-liquid asphalt mixture at the second mixing means exceeds a preselected value.

15. The apparatus of claim 14 wherein the first means for mixing comprises:

a cylinder having a first end and a second end; and means for introducing the stream of liquid asphalt into the cylinder to flow toward the second end; and wherein the second means for mixing comprises:

a cylinder having a first end and a second end; and means for introducing the stream of first additive-liquid asphalt mixture into the cylinder to flow toward the second end.

16. The apparatus of claim 14 further comprising:

a first thermal jacket substantially surrounding the first mixing means; and a second thermal jacket substantially surrounding the second mixing means.

17. The apparatus of claim 14 wherein one of the additives is rubber.

18. The apparatus of claim 14 further comprising means for maintaining the pressure in the first closed pressurized environment at a selected pressure above the pressure of the stream of liquid asphalt at the first mixing means, and means for maintaining the pressure of the second closed pressurized environment at a selected pressure above the pressure of the stream of first additive-liquid asphalt mixture at the second mixing means.

19. The apparatus of claim 13 wherein each mixing means comprises:

a cylinder having a first end and a second end; and wherein the cylinder is further characterized as having an expanded portion extending from the first end and terminating at an intermediate location on the cylinder.

20. The apparatus of claim 19 further comprising;

a first thermal jacket substantially surrounding the first mixing means; and a second thermal jacket substantially surrounding the second mixing means.

21. The apparatus of claim 19 wherein one of the additives is rubber.

22. The apparatus of claim 19 further comprising means for maintaining the pressure in the pressurized environment at a selected pressure above the pressure of the liquid asphalt at the mixing means.

23. An apparatus for mixing a plurality of additives with a stream of liquid asphalt comprising:

a plurality of additive sources;

a mixer for receiving additives and mixing the additives with a stream of liquid asphalt passing therethrough; and a dispenser connected to said additive sources and to the mixer for dispensing additives from the additive sources into the mixer such that the additives are dispensed generally into the center of the stream of liquid asphalt.

24. The apparatus of claim 23 wherein the dispenser and the mixer form a pressurized environment.

25. The apparatus of claim 24 further comprising means for monitoring the pressure in the pressurized environment.

26. The apparatus of claim 24 further comprising means for adjusting the pressure of the pressurized environment.

27. The apparatus of claim 23 wherein the dispenser comprises a valve to interrupt the dispensing of the additives into the mixer when the pressure of the stream of liquid asphalt in the mixer exceeds a preselected value.

28. The apparatus of claim 23 wherein the mixer comprises a cylinder having a first end and a second end, and wherein the cylinder is further characterized as having an expanded portion extending from the first end and terminating at an intermediate location on the cylinder.

29. The apparatus of claim 26 further including a thermal jacket substantially surrounding the mixer.

30. The apparatus of claim 23 wherein one of the additives comprises rubber.

* * * * *

UNITED STATES PATENT AND TRADEMARK OFFICE

CERTIFICATE OF CORRECTION

PATENT NO. : 5,383,725

DATED : January 24, 1995

INVENTOR(S) : Swisher, Jr. et al.

It is certified that error appears in the above-identified patent and that said Letters Patent is hereby corrected as shown below:

Column 3, line 7, after "communicates", insert --with--.

Column 3, line 22, after "first", delete ",".

Signed and Sealed this

Sixth Day of June, 1995

Bruce Lehman

*Attest:*

BRUCE LEHMAN

*Attesting Officer*

*Commissioner of Patents and Trademarks*